US007486025B2

(12) United States Patent
Beland et al.

(10) Patent No.: US 7,486,025 B2
(45) Date of Patent: Feb. 3, 2009

(54) UV DEPRECIATION SENSOR

(75) Inventors: Pascal Beland, St-Nicephore (CA); Stephanie Collins, St-Nicephore (CA); Daniel Marian, Roscoe, NY (US); Alain Richer, Wickam (CA)

(73) Assignee: Osram Sylvania Inc., Danvers, MA (US)

( * ) Notice: Subject to any disclaimer, the term of this patent is extended or adjusted under 35 U.S.C. 154(b) by 599 days.

(21) Appl. No.: 10/850,173

(22) Filed: May 20, 2004

(65) Prior Publication Data

US 2005/0258762 A1 Nov. 24, 2005

(51) Int. Cl.
*H01J 17/16* (2006.01)
*H01J 61/35* (2006.01)

(52) U.S. Cl. ..... 313/635; 313/634; 313/493

(58) Field of Classification Search ..... 313/634, 313/635, 493, 510, 513

See application file for complete search history.

(56) References Cited

U.S. PATENT DOCUMENTS

| | | | | |
|---|---|---|---|---|
| 4,147,823 | A | 4/1979 | Lavallee | 428/35 |
| 4,744,012 | A * | 5/1988 | Bergkvist | 362/84 |
| 4,991,074 | A * | 2/1991 | Kobayashi et al. | 362/457 |
| 5,965,983 | A | 10/1999 | Bouwkamp-Wijnoltz | 313/635 |
| 6,149,839 | A | 11/2000 | Diaz et al. | 252/301.4 F |
| 6,504,305 | B1 * | 1/2003 | Ohkubo et al. | 315/58 |

FOREIGN PATENT DOCUMENTS

JP 03291540 A * 12/1991

* cited by examiner

*Primary Examiner*—Karabi Guharay
*Assistant Examiner*—Kevin Quarterman
(74) *Attorney, Agent, or Firm*—Carlo S. Bessone

(57) ABSTRACT

A lamp having a measurable ultra violet light emission and having thereon a first marking revealing at least the operating characteristics of said lamp and a second marking evidencing a change in characteristics in response to exposure to ultra violet emissions. In a preferred embodiment of the invention a symbol or other indicia is provided on the lamp as the second marking that fades in accordance with the number of hours the lamp is operating, thus providing an indication of the UV output of the lamp.

4 Claims, 1 Drawing Sheet

UV DEPRECIATION SENSOR

TECHNICAL FIELD

This invention relates to lamps and more particularly to fluorescent lamps. Still more particularly it relates to fluorescent utilized for their ultraviolet light (UV) output. such as lamps used for tanning or for medical purposes.

BACKGROUND ART

Fluorescent lamps having a strong UV output have been used for many years as a substitute for sun-tanning and in medical treatments for various skin disorders. It has often been difficult to determine when the effective UV output of the lamp has diminished beyond a useful function since the lamp may continue to emit visible radiation.

For example, the useful life of a fluorescent lamp is determined by the amount of UV radiation present at 500, 800 and 1000 hours, respectively. At the present time there exists no useful determinant of the available amount of UV radiation other than keeping track of the total number of hours the lamps have been illuminated, a troubling and often inaccurate procedure that depends, among other things, upon careful record keeping.

Accordingly, it would be an advance in the art if a determinant could be easily supplied with the lamp to indicate its useful life.

DISCLOSURE OF INVENTION

It is, therefore, an object of the invention to obviate the disadvantages of the prior art.

It is another object of the invention to enhance the operation of UV lamps.

It is another object of the invention to provide an ultraviolet emitting lamp that contains an indicator of its useful life.

These objects are accomplished, in one aspect of the invention, by the provision of a lamp having a measurable ultra violet light emission and having thereon a first marking revealing at least the operating characteristics of the lamp; and a second marking that evidences a change in characteristics in response to exposure to ultra violet emissions. The change in characteristic of the second marking gives a clear indication of the remaining life of the lamp even to persons not especially skilled and greatly enhances the usefulness of such lamps.

BEST MODE FOR CARRYING OUT THE INVENTION

Figure 1:
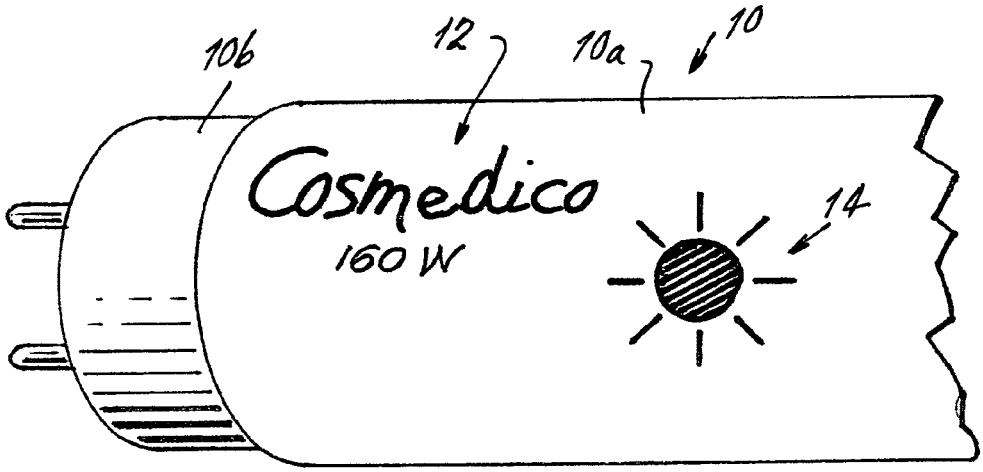
FIG. 1 is a view of the label end of a lamp in a first mode in accordance with an aspect of the invention.
Figure 2:
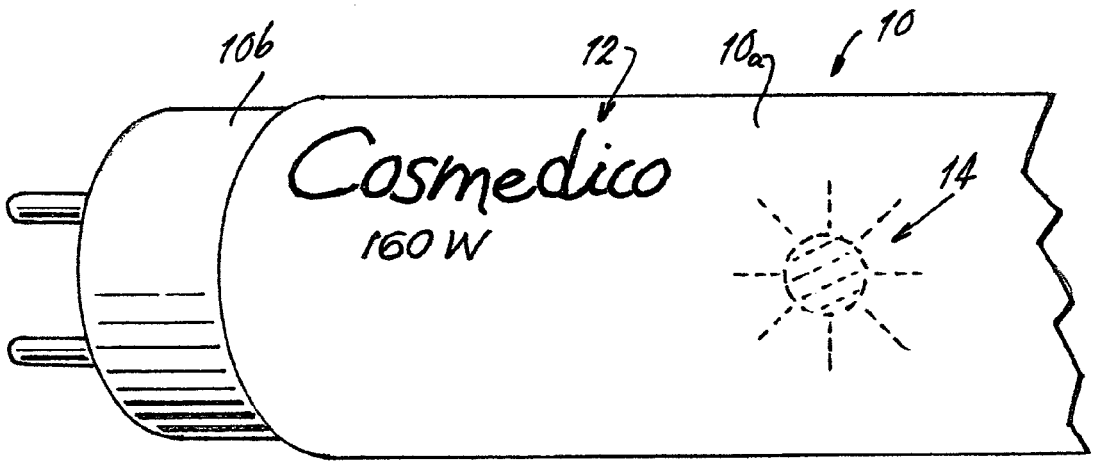
FIG. 2 is a similar view of the label end of a lamp in a second mode of the invention.

For a better understanding of the present invention, together with other and further objects, advantages and capabilities thereof, reference is made to the following disclosure and appended claims in conjunction with the above-described drawings.

Referring now to the drawings with greater particularity, there is shown in the FIGURES a lamp 10 having a measurable ultra violet light emission and having thereon a first marking 12 revealing at least the operating characteristics of said lamp and a second marking 14 evidencing a change in characteristics in response to exposure to ultra violet radiation emissions.

In the embodiment shown the lamp 10 is a fluorescent lamp having an elongated glass body 10*a* terminating in endcaps 10*b* (only one of which is shown), as is known in the art. The first marking 12 is comprised of permanent ink applied by stamping, as is conventional in the art. The second marking 14, which in this instance is shown in the shape of sun, is comprised of ink having a susceptibility to change when constantly exposed to UV radiation. In this particular instance an ink is chosen to fade in direct proportion to the length of exposure to UV radiation and thus indicates the age of the lamp. Therefore, when the second marking fades completely an operator is made aware of the fact that the lamp should be changed, even though the lamp is still emitting visible radiation.

The color of the second marking 14 can be chosen for aesthetic reasons or for other identifying reasons, such as a company identification.

In a preferred embodiment of the invention, a RUCO ink can be employed, especially one from the 110 series. Such inks are available from Ruco, at Autotran Inc., North Reading, Mass. 01864 or Comdec, Inc., Newburyport, Mass. 01950.

Alternatively, a MARABU ink can be employed, especially one from the GL series. Colors vary within the 110 series and the GL series enumerated above. MARABU inks are available from Robert Pope and Co. Ltd., Toronto, Ontario, Canada M6J 2R9

As with any printing process it is important to control the drying time and the viscosity of the inks. This is especially true when printing on a difficult substrate such as glass.

With the MARABU inks designated above a suitable hardener is a GLH series available from the aforementioned Robert Pope. A suitable thinner for the MARABU inks is a GLV, also available from the aforementioned Robert Pope. In any instance the amount of hardener and thinner will depend upon the printing technique being employed.

With the RUCO inks, a suitable hardener (i.e., an adhesion modifier) is a 100-VR-1320 from Autotran. A suitable thinner is a 35696 available from Autotran. The actual amount of hardener and thinner employed will depend upon the printing technique being used.

In a specific example, for a permanent etch a RUCO ink can be mixed with about 3% hardener and 24% thinner, while a suitable mixture for an etch that will disappear in 800 hours is RUCO ink with 2% hardener and 24% thinner.

As a practical matter it is preferred that only a single type of ink be employed at any one time. That is, the permanent ink and the UV sensor ink would be from the same manufacturer. For example, if MARABU ink is used, the permanent ink would use 8% hardener and 15% thinner while the UV sensor ink would use 6% hardener and 15% thinner. Increasing the amount of thinner will increase the life of the ink pot.

Various types of plates can be used for the printing process, such as a steel plate that is used for lose tolerances and long production. A plastic plate can come in specific thicknesses to determine the depth of the cuts on the plate, which in turn determines the amount of ink applied. For example, a depth of cut on the permanent ink plate can be about 0.01 inches while the depth of cut for the fading ink can be about 0.006 inches. The latter ink supply will suffice for an 800 hour lamp.

Any of the primary colors, such as red, blue green orange, yellow or violet, as well as mixtures of these colors are available both for the permanent etch and the fading etch.

Accordingly, there is provided an unique method for determining the replacement period of UV lamps. It is extremely visible and easy to employ by untrained individuals.

While there have been shown and described what are at present considered to be the preferred embodiments of the invention, it will be apparent to those skilled in the art that various changes and modification can be made herein without departing from the scope of the invention as defined by the appended claims.

What is claimed is:

1. In a lamp having a measurable ultra violet light emission and having thereon a first marking revealing at least the operating characteristics of said lamp; the improvement comprising:

a second marking on said lamp, said second marking comprising an etch evidencing a change in characteristics in response to exposure to ultra violet emissions.

2. The lamp of claim 1 wherein said evidence of change comprises the second marking fading.

3. The lamp of claim 2 wherein said fading of said second marking indicates the age of the lamp.

4. The lamp of claim 1 wherein said lamp is a fluorescent lamp.

* * * * *